US009073166B2

(12) United States Patent
Fujimura

(10) Patent No.: US 9,073,166 B2
(45) Date of Patent: Jul. 7, 2015

(54) ELECTRIC CUTTING-TOOL GRINDER

(75) Inventor: Makoto Fujimura, Seki (JP)

(73) Assignee: KAI R&D CENTER CO., LTD., Gifu-ken (JP)

( * ) Notice: Subject to any disclaimer, the term of this patent is extended or adjusted under 35 U.S.C. 154(b) by 0 days.

(21) Appl. No.: 14/110,497

(22) PCT Filed: Apr. 24, 2012

(86) PCT No.: PCT/JP2012/060958

§ 371 (c)(1),
(2), (4) Date: Oct. 8, 2013

(87) PCT Pub. No.: WO2012/147734

PCT Pub. Date: Nov. 1, 2012

(65) Prior Publication Data

US 2014/0030964 A1 Jan. 30, 2014

(30) Foreign Application Priority Data

Apr. 26, 2011 (JP) ..... 2011-098252

(51) Int. Cl.
*B24B 19/00* (2006.01)
*B24B 3/54* (2006.01)
*B24B 55/02* (2006.01)

(52) U.S. Cl.
CPC .. *B24B 3/54* (2013.01); *B24B 55/02* (2013.01)

(58) Field of Classification Search
CPC ..... B24B 19/002; B24B 3/54; B24B 55/045; B24B 55/02; B24B 55/12; B24B 3/36; B24B 3/58; B24D 15/06; B24D 15/08
USPC ..... 451/177, 263, 267, 293, 45, 53, 488, 451/414, 450
See application file for complete search history.

(56) References Cited

U.S. PATENT DOCUMENTS 385,706 A * 7/1888 Ginn ..... 451/555
1,568,185 A * 1/1926 Rogers ..... 451/241

(Continued)

FOREIGN PATENT DOCUMENTS

DE 2020442 A 11/1971
GB 523868 A 7/1940

(Continued)

OTHER PUBLICATIONS

International Preliminary Report on Patentability issued Oct. 29, 2013 in corresponding International application No. PCT/JP2012/060958.

(Continued)

*Primary Examiner* — George Nguyen
(74) *Attorney, Agent, or Firm* — Posz Law Group, PLC

(57) ABSTRACT

The grinding surface of a grinding stone is formed from a circular conical surface, a drive device for rotation is installed within a housing. The blade of a cutting tool is ground while the longitudinal direction of the cutting tool is aligned with the direction of a generating line of the grinding surface. When grinding the blade, the cutting tool can be aligned with the direction of the generating line of the grinding surface and the blade can be brought in contact with the grinding surface without the handle of the cutting tool and the hand that holds the cutting tool being interfered with the grinder. This is achieved irrespective of in which one of the directions of lines the tip of the blade faces, the lines being obtained by extending the generating line of the grinding surface from both ends of the generating line.

17 Claims, 9 Drawing Sheets

(56) References Cited

U.S. PATENT DOCUMENTS

| | | | | |
|---|---|---|---|---|
| 4,048,760 | A * | 9/1977 | Gangelhoff | 451/267 |
| 5,345,726 | A * | 9/1994 | Gach | 451/450 |
| 5,549,509 | A * | 8/1996 | Hirst et al. | 451/178 |
| 5,620,359 | A * | 4/1997 | Harrison et al. | 451/45 |
| 6,224,468 | B1 * | 5/2001 | Blume et al. | 451/48 |
| 6,994,613 | B2 * | 2/2006 | Hacikyan | 451/358 |

FOREIGN PATENT DOCUMENTS

| | | | |
|---|---|---|---|
| JP | 46-798 | B | 1/1971 |
| JP | 48-25358 | B1 | 7/1973 |
| JP | 51-34090 | U | 3/1976 |
| JP | 52-154790 | U | 11/1977 |
| JP | 54-45490 | U | 3/1979 |
| JP | 58-132640 | U | 9/1983 |
| JP | 58-169943 | U | 11/1983 |
| JP | 3-103154 | U | 10/1991 |
| JP | 7-27750 | U | 5/1995 |
| JP | 2004-330322 | A | 11/2004 |
| WO | 2006/130070 | A1 | 12/2006 |

OTHER PUBLICATIONS

International Search Report mailed on May 22, 2012 for the corresponding International patent application No. PCT/JP2012/060958.
Extended European Search Report dated Mar. 2, 2015 issued in corresponding EP patent application No. 12776351.4.

* cited by examiner

ELECTRIC CUTTING-TOOL GRINDER

CROSS REFERENCE TO RELATED APPLICATION

This application is a U.S. national stage application of PCT/JP2012/060958 filed on Apr. 24, 2012, and claims priority to, and incorporates by reference, Japanese Patent Application No. 2011-098252 filed on Apr. 26, 2011.

FIELD OF THE INVENTION

The present invention relates to an electric cutting-tool grinder that grinds a cutting-tool by rotating a grindstone by an electric drive source.

BACKGROUND OF THE INVENTION

A typical grindstone of an electric cutting-tool grinder has a disk shape. The circumferential surface or the end surface of the grindstone is used as a grinding surface. Since the thickness of the grindstone is relatively small, the width of the grinding surface is small when the circumferential surface is used as the grinding surface. Thus, it is not suitable for cutting-tools with a long blade such as a kitchen knife. When the end surface of the grindstone is used as the grinding surface, the blade of the kitchen knife is abutted against the circular grinding surface to cross the grinding surface. Thus, two different grinding motions are simultaneously performed in which the grinding surface rotates toward the blade and in which the grinding surface rotates away from the blade. As a result, half of the blade is pressed by the grinding surface, and the remaining half of the blade is pulled by the grinding surface. Thus, the force that presses the blade and the force that pulls the blade apply force to the blade in the same rotation direction. This tends to rotate the kitchen knife. Thus, the kitchen knife will be unstable and the grinding operation will be difficult to perform.

To resolve such a drawback of the disk-like grindstone, a grindstone has been disclosed in Patent Document 1 that has a wider grinding surface and efficiently grinds a blade. According to this grindstone, a conic surface is formed on the circumferential surface of a disk, and the conic surface is used as the grinding surface. Thus, the width of the grinding surface is increased. Since the grinding surface rotates in one direction with respect to the blade by abutting the blade along the generating line of the conic surface, the entire blade is ground uniformly. Also, since grinding is performed in the range of the length of the generating line, the grindstone is capable of grinding the kitchen knife with a long blade.

However, the grinder of Patent Document 1 has a great drawback with regard to a kitchen knife that needs to be ground on both surfaces of the blade, that is, first and second blade surfaces such as those of an usuba hocho (Japanese vegetable knife). There is no problem when grinding the first blade surface of the usuba hocho, but there is a problem when grinding the second blade surface. More specifically, when grinding the first blade surface of a thin-bladed kitchen knife, an operator first grasps the handle of the kitchen knife with the right hand, and abuts the first blade surface against the generating line of the grinding surface formed by the conic surface. At this time, the grindstone rotates in a direction away from the blade, and grinds the kitchen knife without any problem.

The generating line of the grinding surface formed by the conic surface corresponds to a contour line on both sides when a truncated cone-shaped grindstone is viewed from the front.

When grinding the second blade surface, if the kitchen knife held in the right hand is turned over and ground while the kitchen knife is held in the right hand, the rotation direction of the grindstone with respect to the blade is reversed. As described above, there is no problem in grinding when grinding the first blade surface since the grindstone rotates in the direction away from the blade surface. However, in the case in which the second blade surface is ground while the kitchen knife that has been turned over is held in the right hand, the grindstone rotates toward the blade surface. Thus, the grinding surface collides against the blade edge, and the kitchen knife might be lifted while grinding. Therefore, it is difficult to grind smoothly.

Thus, the distal end of the blade and the handle of the kitchen knife are flipped over such that the handle of the kitchen knife is located on the left side of the operator's body by switching the kitchen knife to the left hand. When the kitchen knife is turned over in this manner and the second blade surface is ground, the grindstone rotates in the direction away from the second blade surface like the first blade surface. However, if the handle of the kitchen knife is located on the left side of the operator's body, when moving the kitchen knife during grinding, the hand and the handle of the kitchen knife interfere with the frame of the grinder, and the movement of the kitchen knife is hindered. Thus, the grinding operation cannot be substantially performed.

Also, when grinding the kitchen knife held in the right hand, it is preferable to place the left hand on the blade so that the kitchen knife will be stable. However, in the case with the grinder of Patent Document 1, the frame gets in the way and the operator cannot place the left hand on the blade.

Furthermore, in the grinder of Patent Document 1, the motor is exposed and noise during use is loud. Such a grinder is not suitable for household use also in the aspect of the design. Thus, in order to sell it to the general public, the motor is preferably covered by a housing. Furthermore, if a grindstone that needs grinding water is used in this grinder, the grinding water falls onto the motor. Thus, when mounting the grindstone that needs grinding water, the motor is also preferably covered by the housing.

PRIOR ART DOCUMENT

Patent Document

Patent Document 1: Japanese Laid-Open Utility Model Publication No. 52-154790

SUMMARY OF THE INVENTION

Problems that the Invention is to Solve

Accordingly, it is an objective of the present invention to provide an electric cutting-tool grinder that is capable of smoothly grinding a blade without the grinder interfering with a handle of a cutting-tool and a hand that holds the cutting-tool when grinding the cutting-tool such as a thin-bladed kitchen knife that require both surfaces of the blade to be ground.

Means for Solving the Problems

In accordance with one aspect of the present invention, an electric cutting-tool grinder including a rotary grinding member that has a grindstone is provided. The rotary grinding member is secured to a rotary shaft rotated by a rotation drive unit to rotate integrally with the rotary shaft. The grindstone includes a grinding surface formed by a conic surface. The rotary grinding member is rotated in a plane perpendicular to the rotary shaft. The rotation drive unit is mounted in a housing. A blade of a cutting-tool is ground with a longitudinal direction of the cutting-tool aligned with the direction of a generating line of the grinding surface, The electric cutting-tool grinder includes means for permitting the cutting-tool to be aligned with the direction of the generating line of the grinding surface and permitting the blade to be abut against the grinding surface without a handle of the cutting-tool and a hand that holds the cutting-tool being interfered by the grinder in the case in which the blade is ground with a tip of the blade of the cutting-tool facing the extending direction of either end of the generating line of the grinding surface.

Thus, the grinding operation is smoothly performed without the cutting-tool and the hand that holds the cutting-tool being interfered with by components of the grinder in either of the cases in which the first blade surface of the blade is abutted against the grinding surface while aligning the cutting-tool held in the right hand with the generating line of the grinding surface, and in which the second blade surface of the blade is abutted against the grinding surface by flipping over the tip of the blade of the cutting-tool and the handle and switching to the left hand so that the cutting-tool is turned over.

The electric cutting-tool grinder preferably includes a guide for moving the cutting-tool that is being ground along the direction of the generating line of the grinding surface. In this case, the guide allows the cutting-tool to be ground in a stable manner.

The generating line located at the highest position of the grinding surface preferably extends horizontally, and the blade of the cutting-tool is preferably ground in a state in which the blade is arranged above the generating line. In this case, the cutting-tool is held horizontally during grinding. Thus, the operation is performed in a more stable manner.

The housing is preferably formed to incline with respect to a vertical line at a predetermined angle, and the predetermined angle is preferably the same angle as the inclination angle of the conic surface, which forms the grinding surface of the grindstone, with respect to the rotary shaft. Further, the rotary shaft preferably also extends diagonally at the same angle as the housing. In this case, the cutting-tool is held horizontally during grinding as in the above-described case.

The housing preferably includes an upper surface portion and an outer circumferential surface, which are formed to be perpendicular to each other, and the rotary shaft preferably extends in the same direction as the direction in which the housing extends. In this case, the generating line of the grinding surface formed by the conic surface is not parallel to the upper surface of the housing and is not parallel to the direction in which the outer circumferential surface of the housing extends. Thus, a space is generated between the handle of the cutting-tool extending in the direction of the generating line and the housing, or the upper surface or the outer circumferential surface of the cover when the cover is mounted on the housing. Thus, the hand or the handle of the cutting-tool does not interfere with the outer circumferential surface of the housing during grinding.

Also, when the tip of the blade of the cutting-tool and the handle are flipped over and the cutting-tool is turned over so that the second blade surface of the blade abuts against the grinding surface, a space is generated between the handle of the cutting-tool and the housing, or the upper surface or the outer circumferential surface of the cover when the cover is mounted on the housing in the same manner. Thus, the hand or the handle of the cutting-tool does not interfere with the components of the grinder during grinding. Thus, the grinding operation is smoothly performed.

The electric cutting-tool grinder preferably includes means for automatically supplying grinding water to the grinding surface of the grindstone. In this case, it is unnecessary to frequently stop the operation to supply the grinding water to the grinding surface during the grinding operation, and the cutting-tool is efficiently ground.

The electric cutting-tool grinder preferably includes a drainage container detachably mounted on the housing. In this case, the housing has an upper surface portion, and the rotary grinding member is mounted above the upper surface portion. The rotary grinding member is covered by a cover. A passage is provided for discharging the grinding water that has collected on the upper surface portion of the housing via the inner surface of the cover to the drainage container as drainage. In this case, the drainage container is easily removed from the housing, and the drainage water is easily drained from the grinder.

The housing preferably includes an upper surface portion for preventing the grinding water that splashes during use from entering the housing. The rotary grinding member is preferably located on the upper side of the upper surface portion. In this case, a cover that covers the rotary grinding member is detachably mounted on the housing, and part of the grinding surface is exposed from part of the cover. In this case, the exposed amount of the grindstone is reduced, and the grinding water is efficiently prevented from splashing to the outside. Furthermore, the strength of the cover is prevented from being reduced.

DETAILED DESCRIPTION OF THE INVENTION

Figure 4:
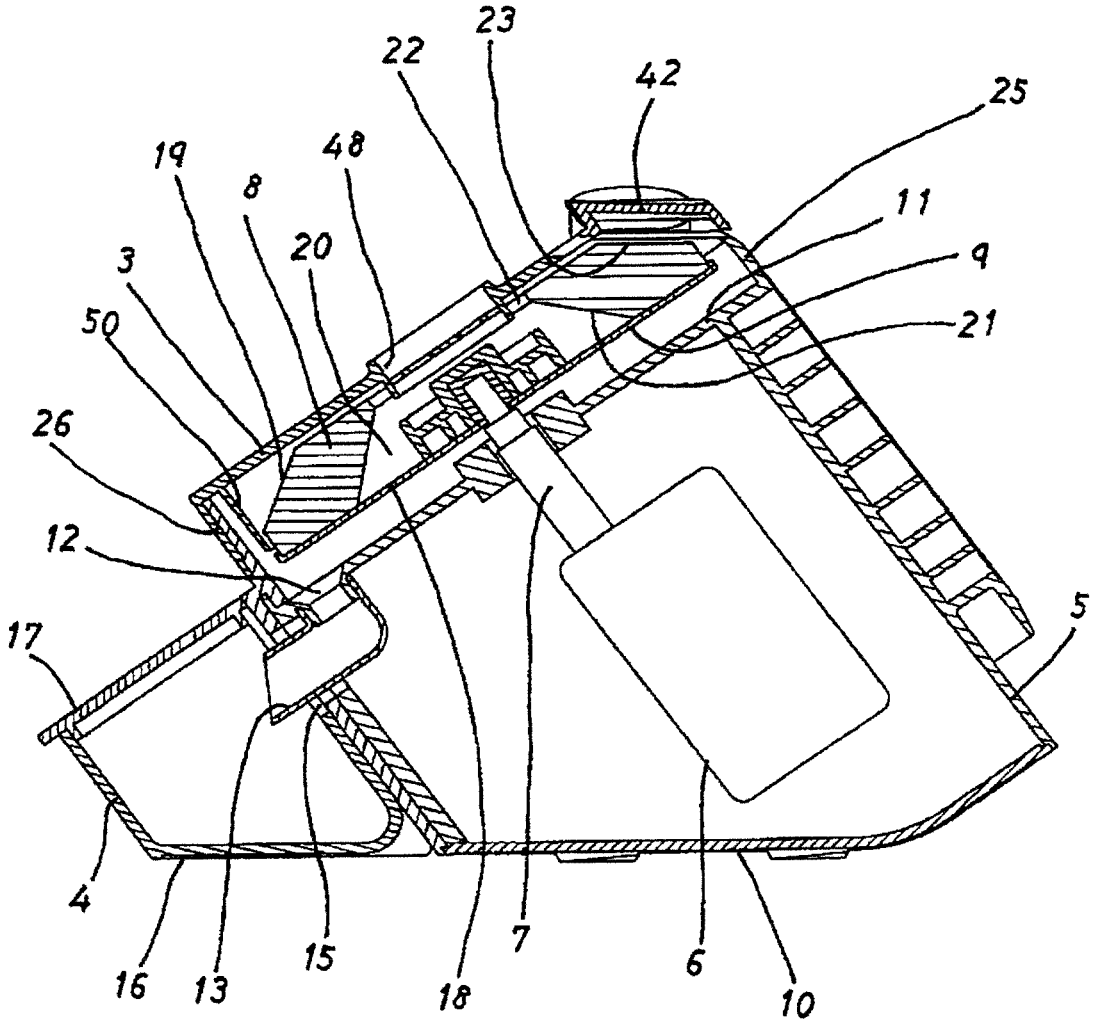
FIG. 4 is a cross-sectional view taken along line 4-4 of FIG. 3.

A cutting-tool grinder 1 according to one embodiment of the present invention includes a grinder main body 2, a cover 3, and a drainage container 4. As shown in FIG. 4, the grinder main body 2 includes a housing 5 and a rotation drive unit, which is a motor 6 located in the housing 5. A rotary grinding member 9, which includes a grindstone 8, is mounted on a rotary shaft 7 of the motor 6 to rotate integrally with the rotary shaft 7. The rotary grinding member 9 is secured to the rotary shaft 7 to rotate in a plane that is perpendicular to the rotary shaft 7.

The housing 5 is formed to be inclined at a predetermined angle with respect to its bottom surface 10, and the rotary shaft 7 is inclined at the same predetermined angle. In this embodiment, the inclination angle of the housing 5 and the rotary shaft 7 with respect to a vertical line is 35 degrees, but is not limited to this numerical value. The housing 5 includes an upper surface portion 11, and the rotary grinding member 9 rotates above the upper surface portion 11. The upper surface portion 11 prevents grinding water from entering inside the housing 5. The upper surface portion 11 of the housing 5 is arranged to be perpendicular to an outer circumferential surface 57 of the housing 5. The upper surface portion 11 has an outlet 12, and a drain pipe 13 is attached to the outlet 12. Thus, drained water received by the upper surface portion 11 is drained outside the housing 5. The drainage container 4, which stores drained water, is detachably mounted on the outer surface of the housing 5. The drain pipe 13 constitutes a passage for draining water to the drainage container 4.

The drainage container 4 has an opening 15 on its side surface, and the drain pipe 13 is inserted in the opening 15. A protrusion (not shown) for hanging the container is formed on the outer surface of the grinder main body 2 that contacts the drainage container 4, and a bore (not shown) that engages with the protrusion is formed in the drainage container 4. The drainage container 4 is mounted on the grinder main body 2 by the engagement between the protrusion and the bore. The drainage container 4 is also formed to be inclined with respect to a bottom surface 16 at the same angle as the housing 5. A detachable lid 17 is mounted on the drainage container 4. Grinding of a cutting-tool is performed by inserting a blade in a guide groove 38 of the cover 3. The drainage container 4 is mounted on the housing 5 on the opposite side of the cover 3 from the guide groove 38. Thus, the drainage container 4 does not interfere with the grinding operation during grinding. A reference numeral 14 indicates part of an electrical cord.

Figure 5:
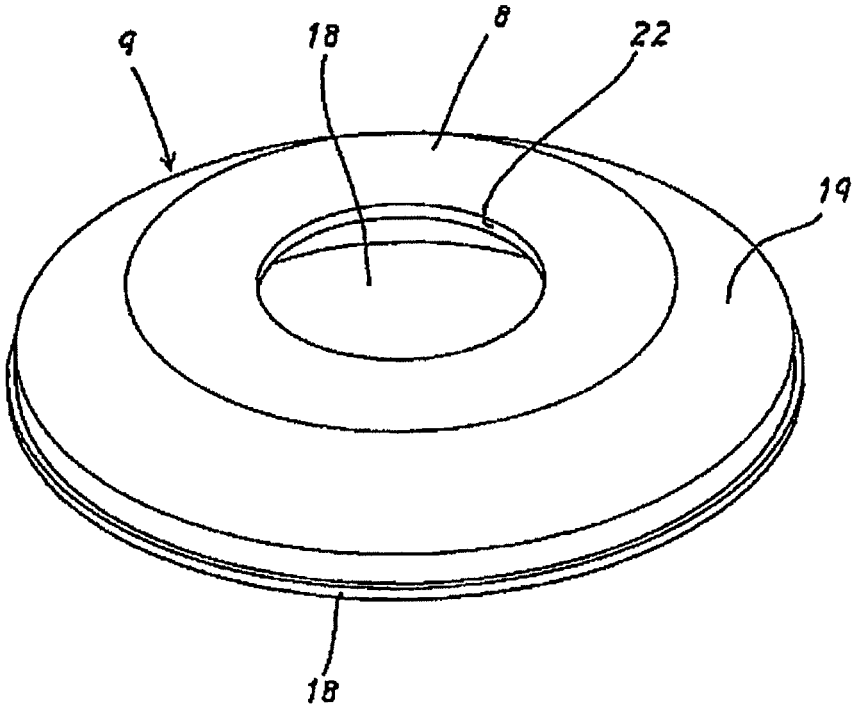
FIG. 5 is a perspective view illustrating the grindstone.
Figure 6:
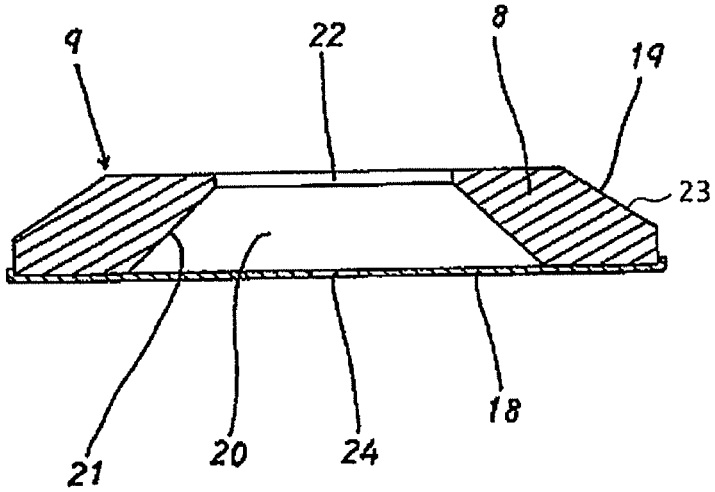
FIG. 6 is a central cross-sectional view illustrating the grindstone.

As shown in FIGS. 5 and 6, the rotary grinding member 9 includes a circular substrate 18 and an annular grindstone 8, which is adhered to the surface of the substrate 18 by an adhesive. A grinding surface 19 is formed by a conic surface. The substrate 18 is made of metal, and the grindstone 8 is formed of material in which water can penetrate. As material permeable to water, alumina-based abrasive grain is used in the present embodiment, but other material may be used such as a natural waterstone. The maximum diameter of the grindstone 8 is 135 mm, and the maximum thickness is 24 mm. The adhering method of the grindstone 8 is not limited to an adhesive, and other method, for example, a metal fitting such as a bolt may be used.

As shown in FIG. 6, the rotary grinding member 9 has a cavity 20 for storing the grinding water inside. The cavity 20 is surrounded by an inner wall 21. The inner wall 21 is formed by an inclined surface, which is inclined inward, and the cavity 20 has a truncated-cone shape widened toward the end. An inlet 22 for the grinding water is formed in the upper center of the grindstone 8. The grinding water is poured into the cavity 20 through the inlet 22. Since the inner wall 21 is inclined inward, the inner diameter of the inlet 22 is smaller than the inner diameter of the bottom of the cavity 20. In this embodiment, the inner diameter of the inlet 22 is 54 mm, and the inner diameter of the bottom of the cavity 20 is 88 mm. However, the inner diameters are not limited to these numerical values.

As shown in FIG. 6, the inclination angle of the conic surface configuring the grinding surface 19 of the grindstone 8, that is, the inclination angle of the grinding surface 19 with respect to the substrate 18, which configures a horizontal surface of the rotary grinding member 9 is 35 degrees. Also, as described above, the inclination angle of the housing 5 and the rotary shaft 7 with respect to the vertical line is also 35 degrees. As a result, a generating line 23 located at the highest position of the grinding surface 19 extends horizontally. When the blade is ground in the vicinity of this generating line 23, the entire cutting-tool is ground while keeping the cutting-tool horizontal. This facilitates the operation.

The grinder 1 includes means for preventing the grinding water that has splashed from the grinding surface 19 from splashing to the outside. One example of the prevention means is an upper circumferential wall 25, which extends circumferentially on the upper surface portion 11 of the housing 5, as shown in FIG. 4. The upper circumferential wall 25 mainly prevents grinding water that splashes in the horizontal direction from splashing to the outside. Another prevention means is the cover 3. The cover 3 mainly prevents the grinding water that splashes upward and in the horizontal direction from splashing to the outside.

Figure 11:
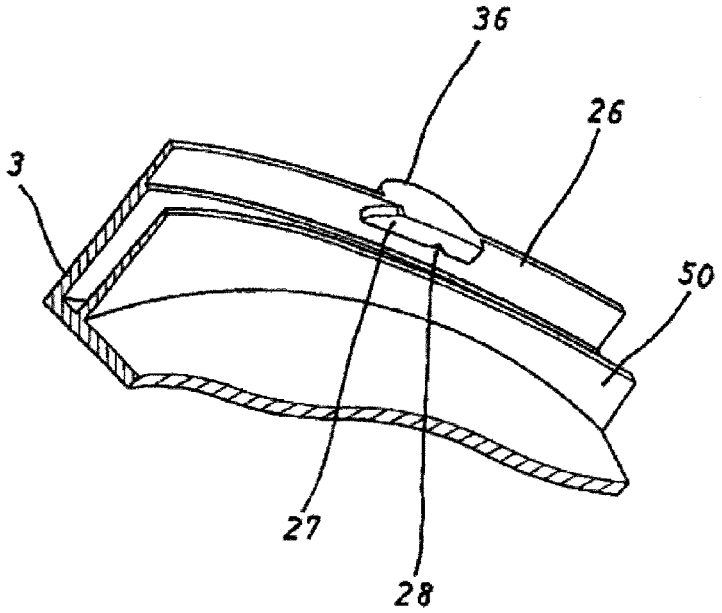
FIG. 11 is a perspective view illustrating an engagement structure of the cover with the grinder main body.

As shown in FIG. 4, the cover 3 is detachably mounted on the upper circumferential wall 25 of the housing 5. A circumferential wall 26 of the cover 3 is fitted to the outside of the upper circumferential wall 25 so that the cover 3 is mounted on the housing 5. Means for preventing the cover 3 from being detached from the housing 5 is provided on the cover 3 and the housing 5. As shown in FIG. 11, an engaging projection 27 for preventing detachment is provided on the inner surface of the circumferential wall 26 of the cover 3. The engaging projection 27 has a locking groove 28.

Figure 10:
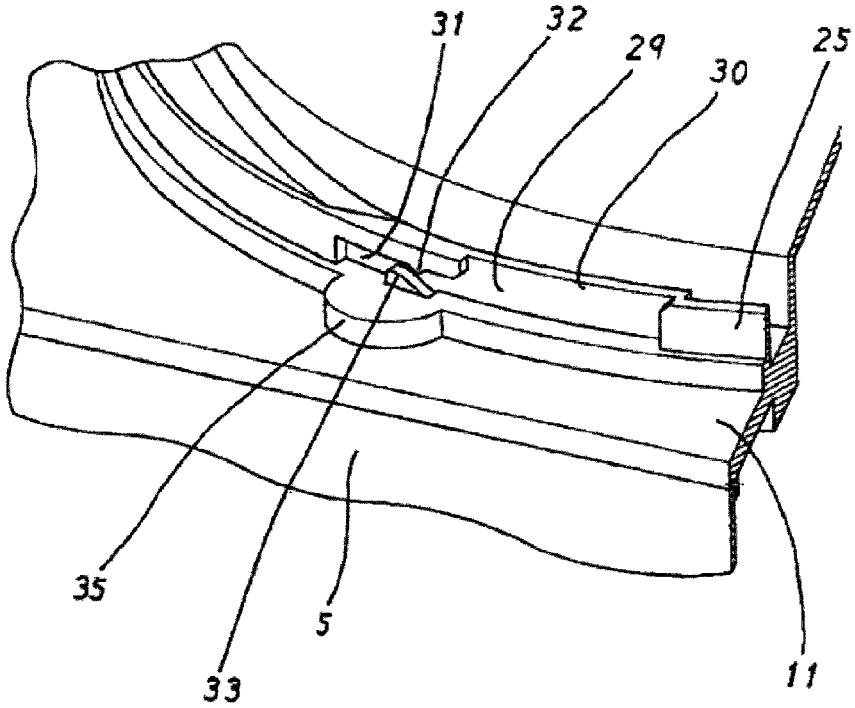
FIG. 10 is a perspective view illustrating an engagement structure of the grinder main body with the cover.

Also, as shown in FIG. 10, a recess 29 for preventing detachment is provided on the surface of the upper circumferential wall 25, which extends along the circumference on the upper surface portion 11 of the housing 5. The recess 29 includes an inlet 30 for introducing the engaging projection 27 of the cover 3, and an engaging recess 31, to which the engaging projection 27 is engaged. The engaging recess 31 has a locking protrusion 32.

Figure 1:
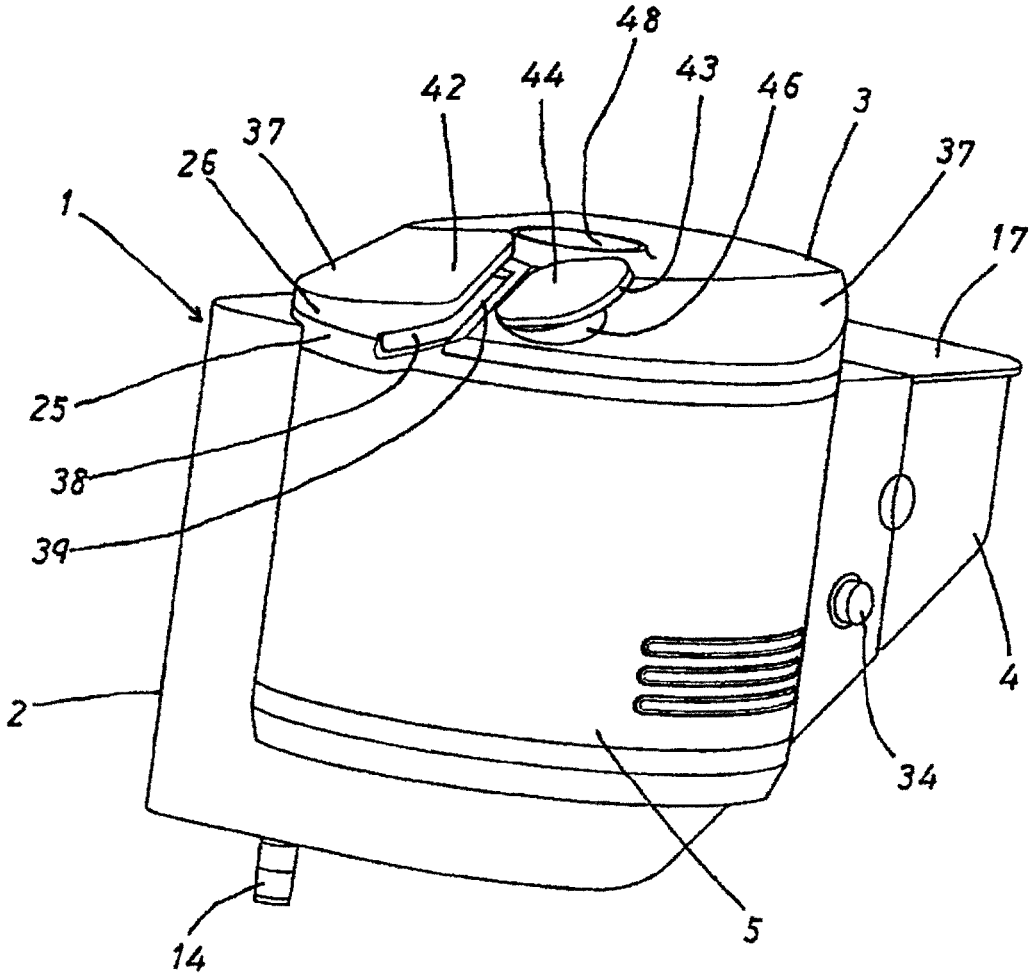
FIG. 1 is a perspective view illustrating a cutting-tool grinder according to one embodiment of the present invention as viewed from the front.

A retractable safety switch 33 is provided in the engaging recess 31. When the safety switch 33 is protruding as shown in FIG. 10, power is not supplied to the motor 6 even if a drive switch 34 shown in FIG. 1 is pressed, and the motor 6 does not rotate. When mounting the cover 3 on the housing 5, the engaging projection 27 of the cover 3 is introduced into the recess 29 through the inlet 30 of the housing 5, and the cover 3 is subsequently rotated in the direction toward the engaging recess 31.

As the cover 3 is continuously rotated, the safety switch 33 sinks by the engagement with the cover 3. When the drive switch 34 is pressed in this state, electric power is supplied to the motor 6, and the motor 6 is rotated. Also, when the locking groove 28 of the cover 3 is engaged with the locking protrusion 32 of the housing 5, the rotation of the cover 3 is stopped at this position, and reverse rotation of the cover 3 is prevented. The reference numeral 35 in FIG. 10 and the reference numeral 36 in FIG. 11 show positioning protrusions. When both the positioning protrusions 35, 36 entirely overlap, the operator can determine that the locking groove 28 of the cover 3 is engaged with the locking protrusion 32 of the housing 5. The engagement structure that is the same as the above engagement structure is provided on the opposite side of the outer circumference portions of the cover 3 and the housing 5, but the safety switch 33 and the positioning protrusions 35, 36 are not provided.

Figure 2:
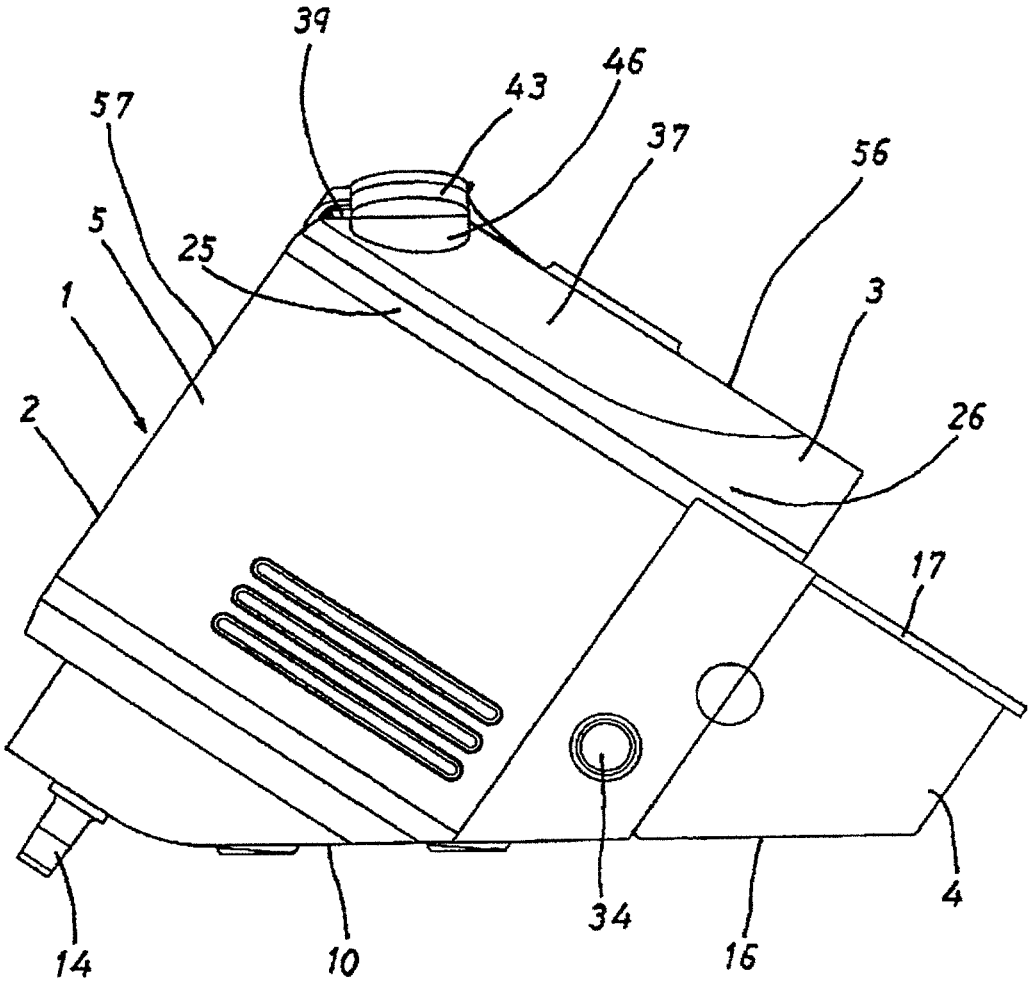
FIG. 2 is a right side view illustrating the cutting-tool grinder.
Figure 3:
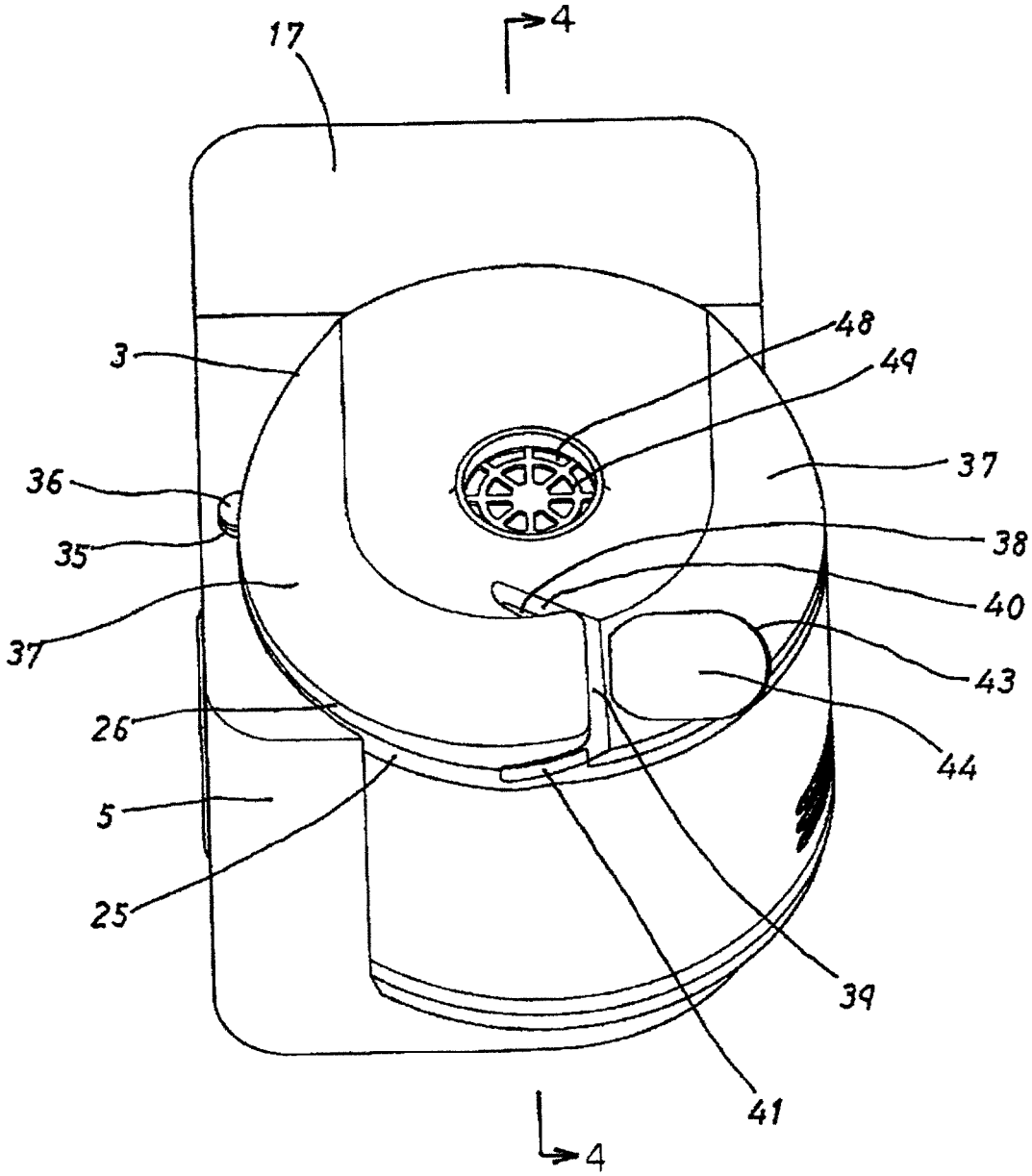
FIG. 3 is a plan view illustrating the cutting-tool grinder.
Figure 12:
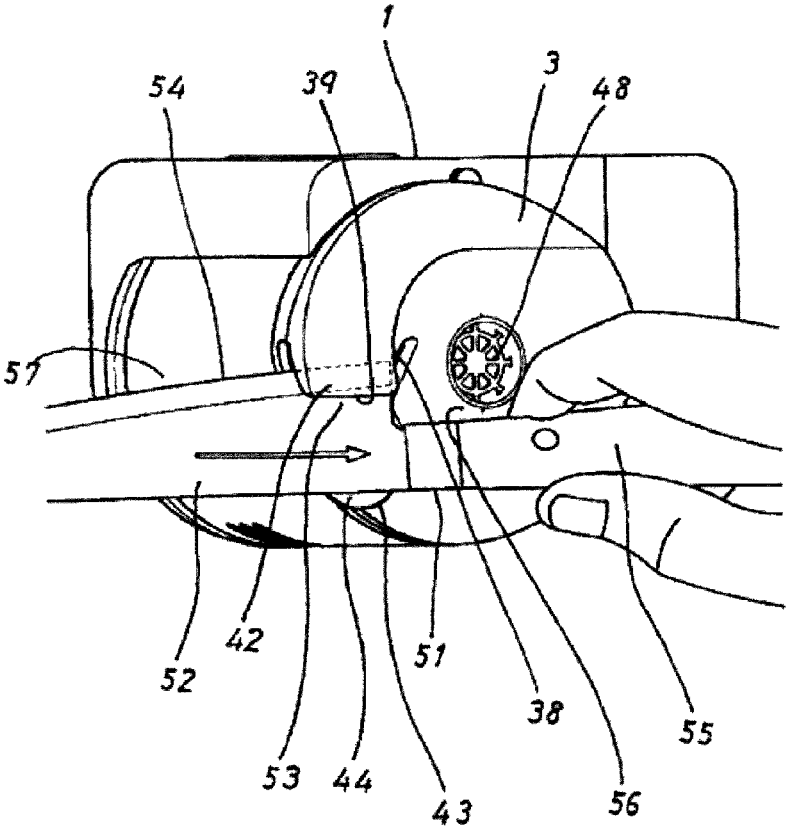
FIG. 12 is a perspective view illustrating a state in which the first blade surface of the kitchen knife is ground.
Figure 13:
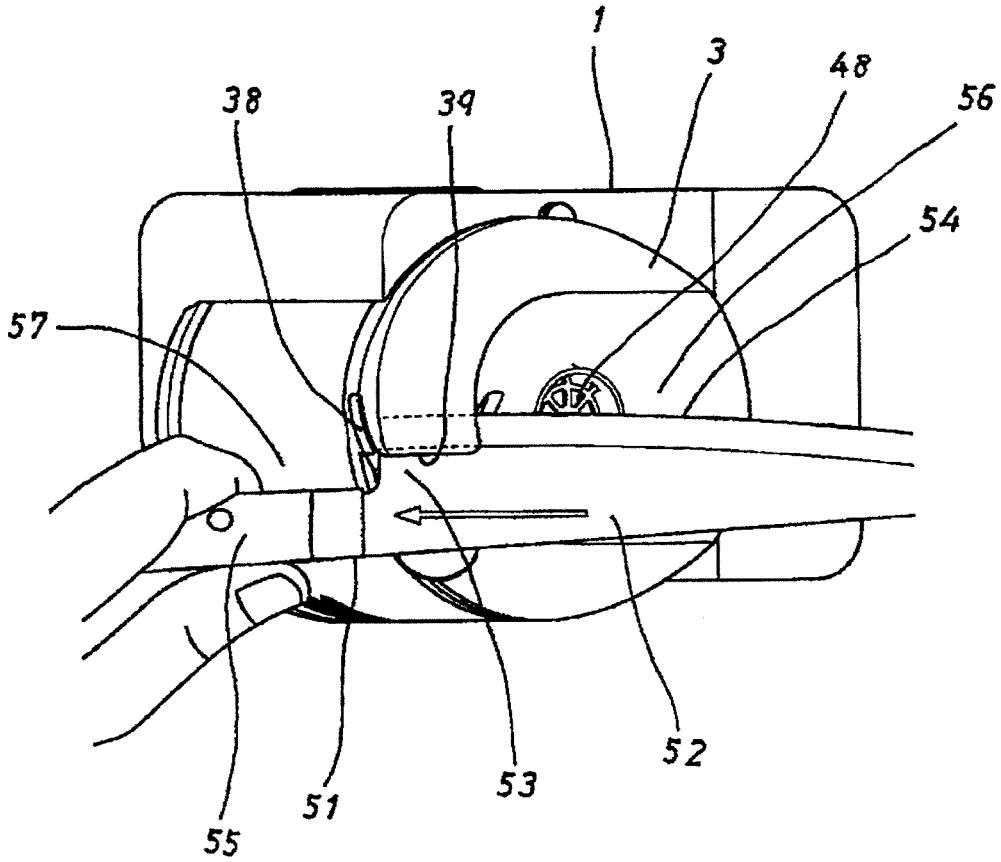
FIG. 13 is a perspective view illustrating a state in which the second blade surface of the kitchen knife is ground.

As shown in FIGS. 1 to 4 and 7, the cover 3 includes a conic surface 37 at part of its outer circumference. The inclination angle of the conic surface 37 is equal to the inclination angle of the grinding surface 19 of the grindstone 8. A guide groove 38 is formed on the conic surface 37. The guide groove 38 includes guide groove inner surfaces 40, 41 and an upper surface portion 42. As shown in FIG. 3, the guide groove inner surfaces 40, 41 are located on both ends of the guide groove 38. The guide groove inner surface 41, which is located outward, is formed by the upper circumferential wall 25 of the housing 5. Since the grinding surface 19 of the grindstone 8 is exposed from the guide groove 38, the blade can be ground by the grinding surface 19 by inserting the blade through an insertion bore 39 of the guide groove 38. The inner width of the insertion bore 39 is set to 7 mm, which is the size that prevents the fingers of the operator from being inserted. Since the guide groove 38 extends in the direction of the generating line of the conic surface 37 of the cover 3 as shown in FIG. 3, when grinding a blade 52, a kitchen knife 51 is moved in the direction of the generating line of the conic surface 37 of the cover 3, that is, in the direction of the generating line of the grinding surface 19 as shown in FIG. 12 or 13. The entire cover 3 or the upper surface portion 42 of the guide groove 38 may be formed to be transparent so that the grinding state can be visually checked. In the present embodiment, the guide groove 38 and a blade support 43 configure a guide for moving the cutting-tool that is being ground in the direction of the generating line of the grinding surface.

Figure 7:
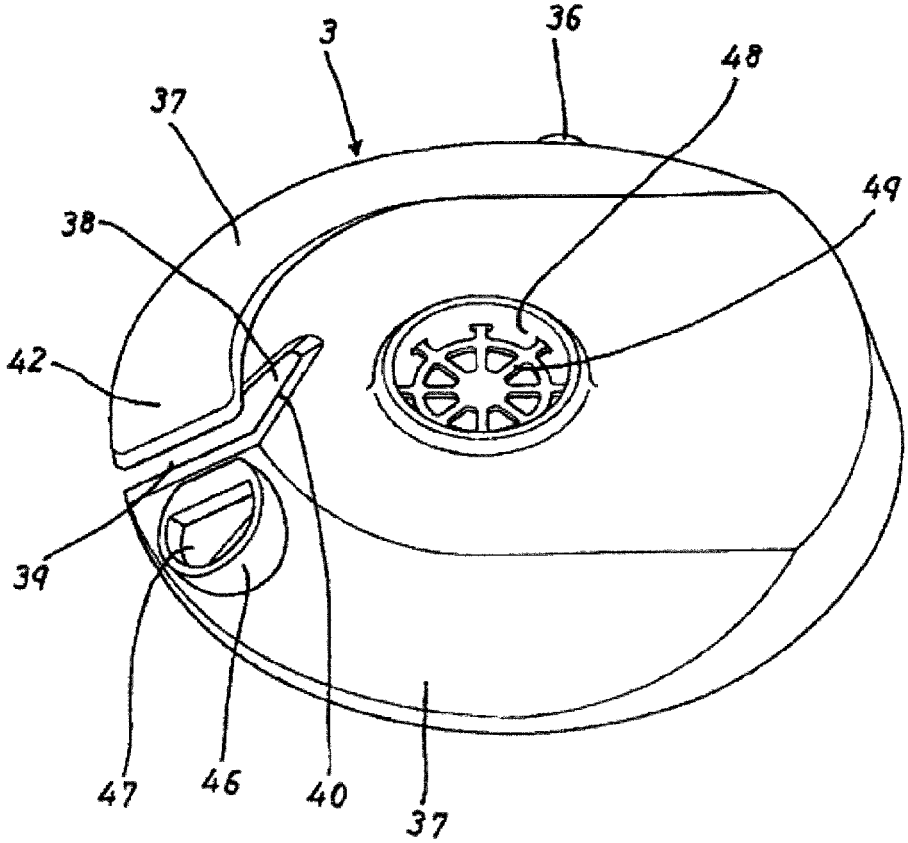
FIG. 7 is a perspective view illustrating the cover.
Figure 8:
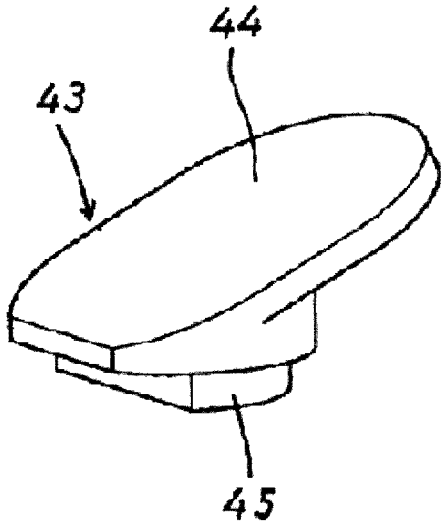
FIG. 8 is a perspective view illustrating a blade support mounted on the cover.
Figure 9:
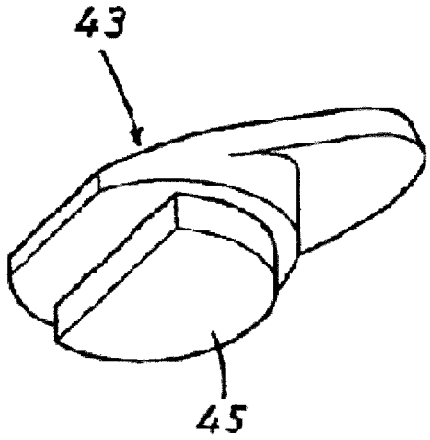
FIG. 9 is a perspective view illustrating the blade support as viewed from the lower side.

The blade support 43 is detachably mounted on the conic surface 37 adjacent to the insertion bore 39. As shown in FIG. 8, the blade support 43 includes a blade support surface 44, which is inclined at a predetermined angle. As shown in FIG. 9, the blade support 43 has a substantially semi-circular fitting portion 45. As shown in FIG. 7, a receiving portion 46 for mounting the blade support 43 is formed on the conic surface 37 of the cover 3. A substantially semi-circular recess 47 is formed in the receiving portion 46. The blade support 43 is mounted on the cover 3 by fitting the fitting portion 45 of the blade support 43 in the recess 47.

When the blade support 43 is mounted on the cover 3, a downward extension line of the blade support surface 44 extends to the insertion bore 39 of the guide groove 38. When the blade is inserted in the guide groove 38 through the insertion bore 39 while being abut against the surface of the blade support surface 44, the blade is abut against the grinding surface 19 at the grinding angle that is the same as the inclination angle of the blade support surface 44 and is ground.

In the present embodiment, the inclination angle of the blade support surface 44 with respect to the grinding surface 19 is 16 degrees, and the grinding angle is also 16 degrees. This angle is preferable for, for example, an usuba hocho used for cooking at home. Since both sides of the thin-bladed kitchen knife are ground, when both sides are ground at the grinding angle of 16 degrees, the cutting edge angle, which is the angle of the cross-section of the blade edge of the kitchen knife, will be 32 degrees.

A preferable grinding angle is obtained by replacing blade supports 43 having the blade support surfaces 44 with different inclination angles in accordance with the cutting-tool. For example, when the inclination angle of the blade support surface 44 is 22 degrees, a grinding angle preferable for a deba hocho (Japanese style kitchen carver) is obtained. Since only one side of the blade is ground for the deba hocho, when the grinding angle is 22 degrees, the cutting edge angle is also 22 degrees. The inclination angle of the blade support surface 44 is of course not limited to these numerical values, and an optimal cutting edge angle is obtained depending on the application by setting to other numerical values. Furthermore, the blade may be first ground by a grinding angle that is a relatively small acute angle, and then ground at a grinding angle that is a relatively large acute angle by replacing the blade support 43. In this manner, the cutting edge angle in the vicinity of the blade edge can be changed, and sharpening of double beveled edge is possible.

A filler opening 48 for pouring the grinding water into the cavity 20 of the rotary grinding member 9 is provided at the center of the cover 3. Ribs 49, which extend in a radial pattern, and an annular rib are provided in the filler opening 48. The ribs 49 minimize splashing of the grinding water from the filler opening 48 during grinding. As shown in FIG. 4, the grinding water poured through the filler opening 48 is poured into the cavity 20 via the inlet 22 of the rotary grinding member 9. An inner wall 50 is provided on the inner side of the circumferential wall 26 of the cover 3. The inner wall 50 is provided such that the splashed grinding water will adhere to the inner wall 50. Thus, it is easy to wash off the splashed grinding water when the cover 3 is removed.

The grinding water stored in the cavity 20 of the rotary grinding member 9 collects at a low part of the cavity 20 since the rotary grinding member 9 is inclined. In this state, when the rotary grinding member 9 is rotated at high speed, centrifugal force is applied to the grinding water. Since the inner wall 21 of the cavity 20 that contacts the grinding water is rotated at high speed, the grinding water is rotated in a state adhered to the inner wall 21. The grindstone 8 is formed of material permeable to water. Thus, the grinding water that penetrated through the inner wall 21 passes through the inside of the grindstone 8 by the centrifugal force and seeps out to the grinding surface 19. The grinding water that has seeped out to the grinding surface 19 is rotated with the grindstone 8, and moves gradually in the outer circumferential direction of the grinding surface 19 by the centrifugal force. However, even when the grinding water moves in the outer circumferential direction, the grinding water immediately contacts the blade edge of the blade. Thus, the movement amount of the grinding water in the outer circumferential direction is small. Therefore, the grinding water hardly splashes from the outer circumference of the grinding surface, and the grinding water necessary for grinding is efficiently supplied. In the present embodiment, the rotary grinding member 9, which includes the cavity 20, configures means for automatically supplying the grinding water to the grinding surface 19.

The method for using the grinder 1 will now be described with reference to FIGS. 12 and 13. In the case with the usuba hocho for cooking, both sides of the blade, that is, the first blade surface and the second blade surface are ground. When grinding the blade of the cutting-tool such as a kitchen knife, the longitudinal direction of the cutting-tool is aligned with the direction of the generating line of the grinding surface 19.

More specifically, FIG. 12 shows the case in which the first blade surface of the blade is ground. When using the grinder 1, the grinder 1 is arranged such that the insertion bore 39 of the guide groove 38 faces the operator. Then, the grinding water is poured into the filler opening 48 of the cover 3, and stored in the cavity 20 of the rotary grinding member 9 by an appropriate amount. Subsequently, the operator grasps a handle 55 of the kitchen knife 51, and presses the drive switch 34 on. In the present embodiment, the grindstone 8 is rotated at a 500 rpm, but the number of rotation is not limited to this. Furthermore, the number of rotation may be variable.

As the grindstone 8 is rotated, the grinding water seeps out to the grinding surface 19. In this state, a heel 53 of the blade 52 is inserted in the guide groove 38 from a blade edge 54. At this time, the blade 52 is abut against the blade support surface 44 of the blade support 43 so that the grinding angle is determined, and the longitudinal direction of the blade 52 is aligned with the direction of the generating line of the grinding surface 19. The surface of the blade edge 54 is ground by the grinding surface 19 while drawing the kitchen knife 51 in the direction of the arrow. The kitchen knife becomes stable by placing the left hand on the blade 52 during grinding. If the kitchen knife 51 is ground while slowly drawing the kitchen knife 51, the blade is ground in a suitable manner by drawing the kitchen knife only once in the arrow direction. The kitchen knife 51 may of course be ground by reciprocating a number of times.

After completing grinding the first blade surface of the blade 52, the kitchen knife 51 is switched to the left hand as shown in FIG. 13, and the second blade surface is arranged with respect to the grinding surface 19 in the same manner as the first blade surface of the blade 52. Then, the second blade surface of the blade 52 is ground while drawing the kitchen knife 51 in the direction of the arrow. At this time, the kitchen knife becomes stable by placing the right hand on the blade 52. When switching the kitchen knife to the other hand, the drive switch 34 may be left on, or the drive switch 34 may be turned off and then turned on again.

In the above-mentioned method for using the grinder 1, the insertion bore 39 for the blade faces the operator as shown in FIG. 2. As apparent from FIG. 2, in the grinder 1 arranged on a flat surface such as a table, the blade insertion bore 39 and the blade support 43 are located at the highest region, the upper surface 56 of the cover 3 is inclined downward to the right, and the outer circumferential surface 57 of the housing 5 is inclined downward to the left.

Since the kitchen knife 51 is held horizontally during grinding of the kitchen knife 51, when grinding the kitchen knife 51 holding it in the right hand as shown in FIG. 12, a triangular space is generated between the handle 55 of the kitchen knife 51, which extends horizontally, and the upper surface 56 of the cover 3 as viewed from the front of FIG. 2. Thus, the right hand that grasps the kitchen knife 51 during grinding does not interfere with the upper surface 56 of the cover 3, and the grinding operation is easy to perform. At this time, the left hand is preferably placed on the blade 52 to stabilize the kitchen knife 51. The left hand does not interfere with the outer circumferential surface 57 on the left side of the housing 5.

Also, when grinding the kitchen knife 51 holding it in the left hand as shown in FIG. 13, a triangular space is generated between the handle 55 of the kitchen knife 51, which extends horizontally, and the outer circumferential surface 57 on the left side of the housing 5 as viewed from the front of FIG. 2. Thus, the left hand that grasps the kitchen knife 51 during grinding does not interfere with the outer circumferential surface 57 on the left side of the housing 5, and the grinding operation is easy to perform. At this time, the right hand is preferably placed on the blade 52 to stabilize the kitchen knife 51. The right hand does not interfere with the upper surface 56 of the cover 3. That is, since the housing 5 and the cover 3 do not interfere with the hand and the handle 55, the grinding operation is smoothly performed even when the kitchen knife 51 is ground while held in either of the left and right hands.

In the present embodiment, the guide groove 38 and the grinding surface 19, which is exposed in the guide groove 38, configure means for permitting the cutting-tool to be aligned with the direction of the generating line of the grinding surface 19 and permitting the blade to be abut against the grinding surface without the handle 55 of the cutting-tool and the hand that holds the cutting-tool being interfered by the grinder 1 in the case in which the blade is ground with the tip of the blade of the cutting-tool such as the kitchen knife 51 facing the extending direction of either end of the generating line of the grinding surface 19.

The present invention may be embodied in various manners. For example, in the above-mentioned embodiment, an usuba hocho having a double-ground edge is described as an example, but a single-edged kitchen knife such as a deba hocho may be ground. Also, other cutting-tools such as a knife or a pair of scissors, which is a single-edged cutting-tool, may be ground.

For example, since a deba hocho is a single-edged knife generally for right-handers, when grinding the blade, there is no problem with the grinder of Patent Document 1. However, a deba hocho for left-handers has an inclined surface along the blade edge on the blade surface opposite to the knife for right-handers. Thus, when grinding the deba hocho for left-handers, it is the same as grinding the deba hocho for right-handers in a state in which the distal end of the blade and the handle are flipped over and the kitchen knife is turned over. Thus, in the grinder of Patent Document 1, the handle of the kitchen knife and the hand that holds the kitchen knife are interfered by the grinder. In contrast, in the grinder of the present embodiment, such interference does not occur. There are also scissors for left-handers, and for grinding of such scissors, the blades are flipped over and ground in the same manner as the deba hocho. However, there is no interference in the grinder of the present embodiment. When grinding a cutting-tool different from the usuba hocho, the blade support 43 corresponding to the cutting-tool may be prepared.

The invention claimed is:

1. An electric cutting-tool grinder comprising a rotary grinding member including a grindstone, wherein the rotary grinding member is secured to a rotary shaft rotated by a rotation drive unit to rotate integrally with the rotary shaft, the grindstone includes a grinding surface formed by a conic surface which defines a generating line of the grinding surface that extends in a direction relative to the conic surface, rotary grinding member is rotated in a plane perpendicular to the rotary shaft, the rotation drive unit is mounted in a housing, a blade of a cutting-tool is ground with a longitudinal direction of the cutting-tool aligned with the direction of the generating line of the grinding surface, and the electric cutting-tool grinder includes means for permitting the cutting-tool to be aligned with the direction of the generating line of the grinding surface and permitting the blade to abut against the grinding surface without a handle of the cutting-tool and a hand that holds the cutting-tool being interfered by the grinder in the case in which the blade is ground with a tip of the blade of the cutting-tool facing the extending direction of either end of the generating line of the grinding surface, wherein the housing is formed to incline with respect to a vertical line at a predetermined angle, the predetermined angle equals an inclination angle of the conic surface which forms the grinding surface of the grindstone, with respect to the rotary shaft, and the rotary shaft extends diagonally at an angle equal to the predetermined angle of incline of the housing.

2. The electric cutting-tool grinder according to claim 1, further comprising a guide for moving the cutting-tool that is being ground along the direction of the generating line of the grinding surface.

3. The electric cutting-tool grinder according to claim 1, wherein, the generating line located at the grinding surface extends horizontally, and the blade of the cutting-tool is ground in a state in which the blade is arranged above the generating line.

4. The electric cutting-tool grinder according to claim 1, wherein the housing includes an upper surface portion and an outer circumferential surface, which are formed to be perpendicular to each other, and the rotary shaft extends in the same direction as the direction in which the housing extends.

5. The electric cutting-tool grinder according to claim 1, further comprising means for automatically supplying grinding water to the grinding surface of the grindstone.

6. The electric cutting-tool grinder according to claim 3, wherein the housing includes an upper surface portion for preventing grinding water that splashes during use from entering the housing, the rotary grinding member is located on the upper side of the upper surface portion, a cover that covers the rotary grinding member is detachably mounted on the housing, and part of the grinding surface is exposed from part of the cover.

7. The electric cutting-tool grinder according to claim 1, wherein the generating line of the grinding surface that extends parallel to the conic surface.

8. The electric cutting-tool grinder comprising:

a rotary grinding member including a grindstone, the rotary grinding member is secured to a rotary shaft rotated by a rotation drive unit to rotate integrally with the rotary shaft, the grindstone includes a grinding surface formed by a conic surface which defines a generating line of the grinding surface that extends in a direction relative to the conic surface, rotary grinding member is rotated in a plane perpendicular to the rotary shaft, the rotation drive unit is mounted in a housing, a blade of a cutting-tool is ground with a longitudinal direction of the cutting-tool aligned with the direction of the generating line of the grinding surface, and the electric cutting-tool grinder includes means for permitting the cutting-tool to be aligned with the direction of the generating line of the grinding surface and permitting the blade to abut against the grinding surface without a handle of the cutting-tool and a hand that holds the cutting-tool being interfered by the grinder in the case in which the blade is ground with a tip of the blade of the cutting-tool facing the extending direction of either end of the generating line of the grinding surface, a drainage container detachably mounted on the housing, wherein the housing has an upper surface portion, and the rotary grinding member is mounted above the upper surface portion, the rotary grinding member is covered by a cover, and a passage is provided for discharging grinding water that has collected on the upper surface portion of the housing via the inner surface of the cover to the drainage container as drainage.

9. The electric cutting-tool grinder according to claim 8, wherein the generating line of the grinding surface that extends parallel to the conic surface.

10. An electric cutting-tool grinder comprising a rotary grinding member including a grindstone, wherein the rotary grinding member is secured to a rotary shaft rotated by a rotation drive unit to rotate integrally with the rotary shaft, the grindstone includes a grinding surface formed by a conic surface which defines a generating line of the grinding surface that extends in a direction relative to the conic surface, the rotary grinding member is rotated in a plane perpendicular to the rotary shaft, the rotation drive unit is mounted in a housing, the rotary grinding member is constructed to permit a blade of a cutting-tool to be grounded with a longitudinal direction of the cutting-tool aligned with the direction of generating line of the grinding surface, and the electric cutting-tool grinder is constructed to permit the cutting-tool to be aligned with the direction of the generating line of the grinding surface and permit the blade to abut against the grinding surface without a handle of the cutting-tool and a hand that holds the cutting-tool being interfered by the grinder in the case in which the blade is ground with a tip of the blade of the cutting-tool facing the extending direction of either end of the generating line of the grinding surface, and wherein the housing is formed to incline with respect to a vertical line at a predetermined angle, the predetermined angle equals an inclination angle of the conic surface, which forms the winding surface of the grindstone, with respect to the rotary shaft, and the rotary shaft extends diagonally at an angle equal to the predetermined angle of incline of the housing.

11. The electric cutting-tool grinder according to claim 10, further comprising a guide that is constructed to move the cutting-tool that is being ground along the direction of the generating line of the grinding surface.

12. The electric cutting-tool grinder according to claim 10, wherein, the generating line located at the grinding surface extends horizontally, and the blade of the cutting-tool is ground in a state in which the blade is arranged above the generating line.

13. The electric cutting-tool grinder according to claim 10, wherein the housing includes an upper surface portion and an outer circumferential surface, which are formed to be perpendicular to each other, and the rotary shaft extends in the same direction as the direction in which the housing extends.

14. The electric cutting-tool grinder according to claim 10, wherein the electric cutting-tool grinder is constructed to automatically supply grinding water to the grinding surface of the grindstone.

15. The electric cutting-tool grinder according to claim 10, further comprising a drainage container detachably mounted on the housing, wherein the housing has an upper surface portion, and the rotary grinding member is mounted above the upper surface portion, the rotary grinding member is covered by a cover, and a passage is provided for discharging grinding water that has collected on the upper surface portion of the housing via the inner surface of the cover to the drainage container as drainage.

16. The electric cutting-tool grinder according to claim 12, wherein the housing includes an upper surface portion for preventing grinding water that splashes during use from entering the housing, the rotary grinding member is located on the upper side of the upper surface portion, a cover that covers the rotary grinding member is detachably mounted on the housing, and part of the grinding surface is exposed from part of the cover.

17. The electric cutting-tool grinder according to claim 10, wherein the generating line of the grinding surface that extends parallel to the conic surface.

* * * * *